United States Patent [19]

Hoen

[11] 4,232,890

[45] Nov. 11, 1980

[54] FASTENER WITH CAMMING HANDLE

[75] Inventor: Cuyler Hoen, Rennesselaer, N.Y.

[73] Assignee: Simmons Fastener Corporation, Albany, N.Y.

[21] Appl. No.: 19,280

[22] Filed: Mar. 9, 1979

[51] Int. Cl.[3] ..... E05C 5/02

[52] U.S. Cl. ..... 292/114; 292/DIG. 38

[58] Field of Search ..... 292/DIG. 38, 114, 113, 292/338, DIG. 15

[56] References Cited

U.S. PATENT DOCUMENTS

| | | | |
|---|---|---|---|
| 888,117 | 5/1908 | Rasmussen | 292/114 |
| 1,606,149 | 11/1926 | Crewson | 292/338 |
| 1,835,660 | 12/1931 | Magnuson | 292/114 |
| 2,120,111 | 6/1938 | Moseley | 292/114 |
| 2,731,238 | 1/1956 | French et al. | 292/114 X |

*Primary Examiner*—Richard E. Moore

*Attorney, Agent, or Firm*—Eliot S. Gerber

[57] ABSTRACT

A fastener includes a plastic strike having a rounded flange and a fastener body assembly comprising (i) a plastic fastener body member having an integral raised portion with a cam area; (ii) a plastic handle member having a gripping portion, a central portion having a cam face and an extension portion having a hook-like member; and (iii) means connecting the fastener body member and the handle member to permit translation and rotation of the handle member.

9 Claims, 11 Drawing Figures

FASTENER WITH CAMMING HANDLE

BACKGROUND OF THE INVENTION

The present invention relates to industrial fasteners and more particularly to a plastic resin fastener.

Many types of fasteners have been proposed for use to permit the closing and opening of panels and boxes. Generally it is desired that such fasteners be strong enough to hold the panels together, or retain the cover on a box, under greater forces of separation than are necessary to open or close the fastener. In certain circumstances, for example, on containers used on ships or in chemical plants, it is desirable that the fastener not have any metal parts, i.e., be constructed of a suitable plastic resin to withstand the adverse salt spray or chemical environment. In addition, plastic resin fasteners may be required around sensitive compasses or other types of instruments affected by the presence of metal. In other circumstances a plastic resin fastener may be desirable because of its low weight, its attractive appearance or because of cost factors.

Many of the presently commercially available fasteners, for example, of the type used on tackle or tool boxes, are constructed of metal. Some of those fasteners may use a toggle action in which one or more metal members rotate about a pin. However, if the pin should become damaged or bent because of the opening load or because the container or panel is dropped or mishandled because of rust, the fastener may become inoperative.

U.S. Pat. Nos. 3,181,905 and 3,466,076, both entitled "Draw Pull Catch", show plastic industrial fasteners in which a catch includes, as one of its members, a complex molded member of the plastic resin polypropylene to provide spring-like connecting webs. Such fasteners may be considered to be relatively weak in their web areas and require almost a rotation of the movable member, about 180°, before they come into a position to be locked.

U.S. Pat. No. 3,338,449 for "Box Construction" and U.S. Pat. No. 3,109,675 for "Toggle Type Window Lock" each show metal fasteners which operate by a toggle action. Such metal toggle fasteners are not usable in certain applications, for example, in adverse environments such as salt water or chemical spray, or where the metal would interfere with instruments. In addition, the toggle action depends upon a free rotational movement on pins, and the openings for such pins may prove a weak point of the fastener.

A plastic toggle action fastener is shown in U.S. Pat. No. 3,134,617. However, it is relatively complex and may not be able to withstand strong opening forces because it relies upon a relatively thin plastic section.

SUMMARY, FEATURES AND OBJECTIVES OF THE INVENTION

In accordance with the present invention a plastic resin fastener is presented which may be injection-molded from a suitable plastic, such as nylon, in three members. A strike member is adapted to be connected to one panel, for example, the cover of a box, and has a protrusion portion, preferably a rounded flange.

The fastener body assembly comprises a plastic fastener body, a plastic handle member and connecting means. The connecting means is preferably two pins which protrude from the fastener body into respective cut-outs in the side walls of the handle member. The handle member forms a cavity which fits over a raised portion of the fastener body. A cam surface of the handle member rides on the cam area of the raised portion and is retained in a cut-back over-ride area of the fastener body.

It is a feature of the present invention to provide a plastic resin fastener for removably attaching a first panel to a second panel. The fastener includes a plastic resin strike member adapted to be secured to said first panel and having a protrusion means such as a rounded flange portion. The fastener also includes a plastic resin fastener body member having a body portion with a flat outer area which lies against the second panel and an inner area opposite the outer area and a raised portion having a slanting cam area merging thereto and a cut-back area. A plastic resin handle member is attached to the fastener body. The handle member has a gripping portion with a flat inner area which lies against the body portion inner area upon closure of the fastener and a central portion forming a cavity having a cam surface joing its rear wall and the flat inner area. The cam surface rides on the body portion and is removably secured in its cut-back upon closure of said fastener. The handle member also has an extension portion having a hook-like member which removably catches the strike member protrusion means for closing said fastener. The attachment of the handle member and the fastener body is by connecting means so that they do not separate and the connecting means permits rotational movement and movement toward and away from the strike of the handle member.

it is an objective of the present invention to provide a fastener whose parts are moldable from a suitable plastic resin.

It is a further objective of the present invention to provide such a fastener which uses relatively less force for closing or opening the fastener than the fastener holds against force separating the panels to which the fastener is attached.

BRIEF DESCRIPTION OF THE DRAWINGS

Other objectives and features of the present invention will be apparent from the following detailed description of the present invention which provides the inventor's best mode of practicing the invention and which should be taken in conjunction with the accompanying drawings.

In the drawings.

DETAILED DESCRIPTION OF THE INVENTION

Figure 1:
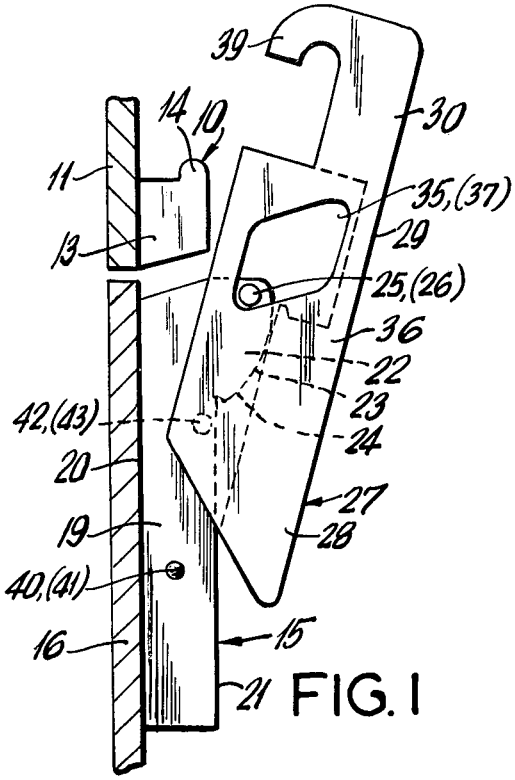
FIG. 1 is a side view of the fastener of the present invention showing the fastener in its open position.
Figure 2:
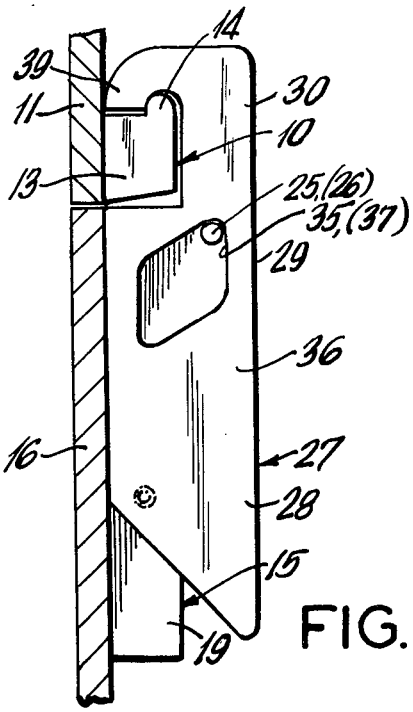
FIG. 2 is a side view of the fastener of FIG. 1 and showing the fastener in its closed (locked) position.
Figure 3:
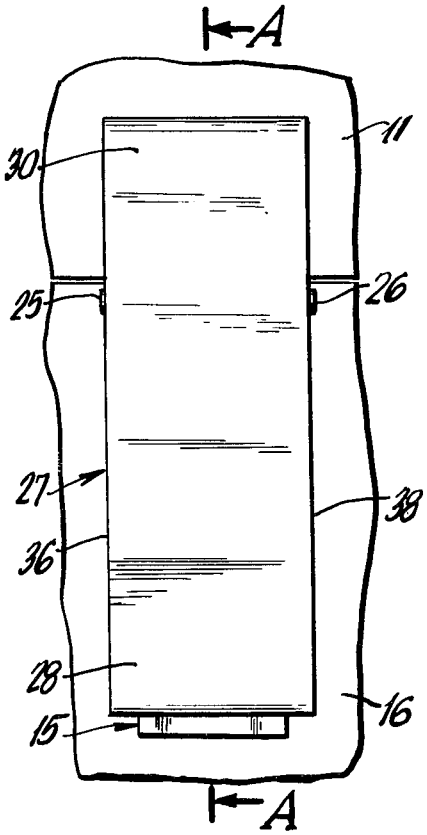
FIG. 3 is a top plan view of the fastener shown in its closed position as in FIG. 2.
Figure 4:
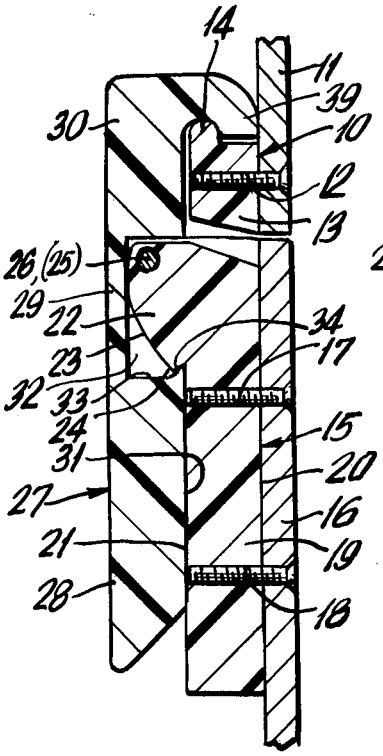
FIG. 4 is a sectional view taken along the line A-A of FIG. 3 with the view being taken in the direction of the arrows.
Figure 5:
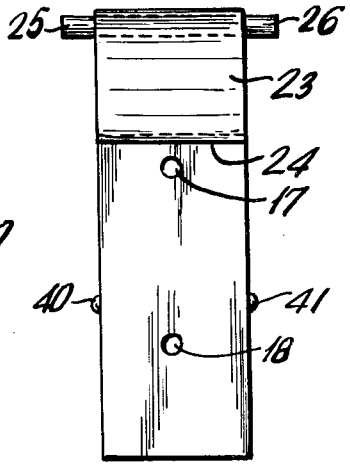
FIG. 5 is a top plan view of the fastener body used in the fastener of FIGS. 1–4.
Figure 6:
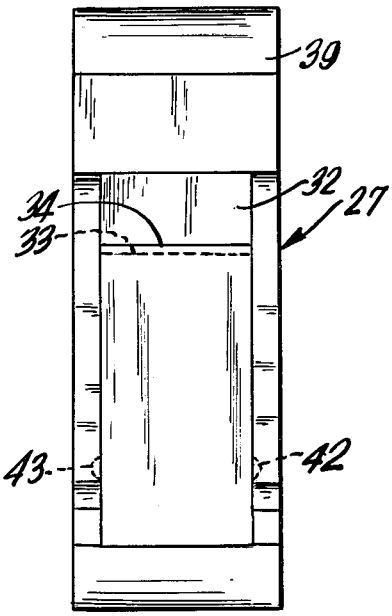
FIG. 6 is a bottom plan view of the handle member used in the fastener of FIGS. 1–4.
Figure 7:
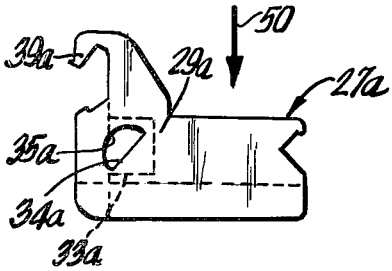
FIG. 7 is a side view of the handle member of an alternative embodiment of the present invention.
Figure 8:
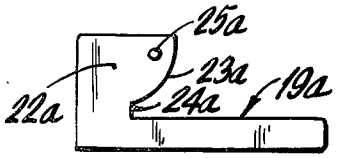
FIG. 8 is a side view of the fastener body member used in conjunction with the handle member of FIG. 5.
Figure 9:
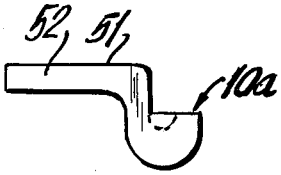
FIG. 9 is a side view of the keeper plate which is used in conjunction with the fastener of FIGS. 5 and 6.

The present invention provides a fastener whose portions may be inexpensively and accurately made from a suitable plastic resin. For example, they may be manufactured by compression molding nylon or another suitable plastic resin.

The first embodiment of the fastener of the present invention is shown in FIGS. 1 through 6. It comprises a strike member 10 which is fastened to a panel member 11 by means of counter-sunk screws or rivets or other fastening means such as an adhesive. The screws protrude through two holes, only one of which holes 12 is shown. The strike member 10 has a body portion 13 and a protrusion means 14 integral therewith. Preferably the protrusion means 14 is a rounded flange portion.

The fastener also includes a fastener body member 15 which is connected to a second panel 16 by means of screws or rivets which protrude through the holes 17 and 18. The fastener body member 15 comprises a body portion 19 having a flat outer area 20 flush with and fastened to the panel 16. The fastener body member 15 also has a flat inner area 21 opposite and parallel to the flat outer area 20. A raised portion 22 of the fastener body member 15 is integral with the body portion 19. The raised portion 22 has a slanting cam area 23 which merges into a cut-back over-ride area 24. The rasied portion 22 carries pins 25 and 26 (connecting means) which protrude outwardly sideways from the raised portion 22.

The handle member 27 includes, as integral portions thereof, a gripping portion 28, a central portion 29 and an extension portion 30. The gripping portion 28 has a flat inner area 31 which becomes flush with the flat outer area 21 upon closure of the fastener. The central portion 29 forms a cavity 32 having a rear wall 33. A cam surface 34 is formed by the rounded corner where the rear wall 33 merges with the flat inner area 31. That cam surface 34 is adapted to ride on the slanting cam area 23 and to be held in the cut-back over-ride area 24 where the fastener is closed. The pin 25 rides within a cut-out 35 in the sidewall 36 of the handle member 27. Similarly the pin 26 rides within the cut-out 37 of the sidewall 38 of the handle member 27.

The extension portion 30 of the handle member 27 has an integral hook-like member 39 which is adapted to catch onto the protrusion means 14 of the strike member 10. The pins 25 and 26 may be a single metal or plastic pin driven through a hole within the raised portion 22 so that the pin protrudes out the ends of the raised portion 22. Alternatively the pins 25 and 26 may be separate metal or plastic pins driven into holes in the raised portion 22, or the pins may be plastic extension portions (protrusions) molded integrally with the handle member 27. The pins 25,26 are used to hold together the handle member 27 and the fastener body member 15. They permit the handle member 27 to rotate and also to move upwardly towards the strike member 10 in order to close the fastener.

Preferably the fastener 15 is provided at its opposite sides with two small bosses (bumps) 40 and 41 which act as detents as the basses 40,41 fit in the respective cavities 42,43 in the opposite inner walls of the sidewalls 36 and 38. Alternatively, the cavity 42,43 may be holes through sidewalls 36 and 38 respectively.

Although not shown, an alternative embodiment would be that the cut-outs 35,37 would be cavities and not through-holes, in order to improve the appearance of the fastener and present flush sidewalls 36 and 38.

The alternative embodiments shown in FIGS. 7–11 are adapted for different directions of closure or for attachment to particular panels. In the embodiments of FIGS. 7–12 the numbers designating the same or similar parts are designated with the same number and with a letter suffix.

Figure 10:
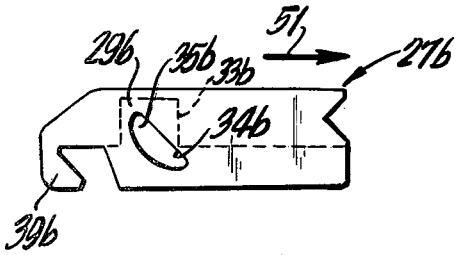
FIG. 10 is a side view of the handle member of the fastener of the present invention.
Figure 11:
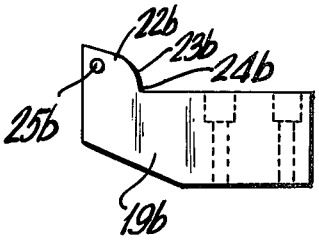
FIG. 11 is a side plan view of the fastener body member of the third embodiment of the present invention which is used in conjunction with the handle member of FIG. 8.

In the fastener embodiment shown in FIGS. 10 and 11, the closure force (pull down force) is in the direction of arrow 51 and the opening force in the opposite direction. In this embodiment the strike may be of the type shown in FIG. 4. The body portion **19*b* is attachable to a second panel and has a raised portion 22*b* with a cam area 23*b* and connecting means 25*b*. The handle member 27*b* has an opening 35*b*, a hook-like member 39*b* and a central portion forming a cavity. The rear wall 33*b* of the cavity has a cam surface 34*b* which rides in cam area 23*b* and is retained in cut-back over-ride area 24*b***.

The fasteners of the above-described embodiments are of plastic resin material. However, the fastener of the present invention may alternatively be partially or wholly constructed of other materials, such as die-cast metal or machined metal materials.

What is claimed is:

1. A fastener for removably attaching a first panel to a second panel comprising a strike member adapted to be secured to said first panel and having a protrusion means;

a plastic resin fastener body member having a body portion with an outer area to be secured to said second panel and an inner area opposite said outer area and having a raised portion having a slanting cam area merging thereto and a cut-back area;

a plastic resin handle member having a gripping portion with an inner area which lies against said fastener body member inner area upon closure of the fastener, a central portion forming a cavity having a cam surface joining its rear wall and its said inner area, said cam surface riding on said cam area and being removably secured in said cut-back upon closure of said fastener, and an extension portion having a hook-like member which removably catches said strike member protrusion means for closing said fastener; and means connecting said handle member and said fastener body member to permit rotational movement of said handle member and its movement toward and away from said strike member.

2. A fastener as in claim 1 wherein said strike is a one-piece plastic resin member.

3. A fastener as in claim 1 wherein said protrusion means of said strike is a rounded flange portion integral with said strike.

4. A fastener as in claim 1 wherein said two inner means are both flat.

5. A fastener for removably attaching a first panel to a second panel comprising a one-piece plastic resin strike member adapted to be secured to said first panel and having a protrusion means which is a rounded flange portion of said strike;

a plastic resin fastener body member having a body portion with a flat outer area to be secured to said second panel and a flat inner area opposite to said flat outer area and a raised portion having a slanting cam area merging thereto and cut-back area;

a plastic resin handle member having a gripping portion with a flat inner area which lies against said flat fastener body inner area upon closure of the fastener, a central protion forming a cavity having a cam surface joining its rear wall and its said flat inner area, said cam surface riding on said cam area and being removably secured in said cut-back upon closure of said fastener, and an extension portion having a hook-like member which removably catches said strike member protrusion means for closing said fastener; and means connecting said handle member and said fastener body member permit rotational movement of said handle member and its movement toward and away from said strike member.

6. A fastener for removably attaching a first panel to a second panel comprising a strike member adapted to be secured to said first panel and having a protrusion means;

a fastener body member having a body portion with an outer area to be secured to said second panel and an inner area opposite said outer area and having a raised portion having a slanting cam area merging thereto and a cut-back area;

a handle member having a gripping portion with an inner area which lies against fastener body member inner area upon closure of the fastener, a central portion forming a cavity having a cam surface joining its rear wall and its said inner area, said cam surface riding on said cam area and being removably secured in said cut-back upon closure of said fastener, and an extension portion having a hook-like member which removably catches said strike member protrusion means for closing said fastener; and means connecting said handle member and said fastener body member permit rotational movement of said handle member and its movement toward and away from said strike member.

7. A fastener as in claim 6 wherein said protrusion means of said strike is a rounded flange portion integral with said strike.

8. A fastener as in claim 6 wherein said two inner means are both flat.

9. A fastener for removably attaching a first panel to a second panel comprising a one-piece strike member adapted to be secured to said first panel and having a protrusion means whichis a rounded flange portion of said strike;

a fastener body member having a body portion with a flat outer area to be secured to said second panel and a flat inner area opposite to said flat outer area and a raised portion having a slanting cam area merging thereto and cut-back area;

a handle member having a gripping portion with a flat inner area which lies against said flat fastener body inner area upon closure of the fastener, a central portion forming a cavity having a cam surface joining its rear wall and its said flat inner area, said cam surface riding on said cam area and being removably secured in said cut-back upon closure of said fastener, and an extension portion having a hook-like member which removably catches said strike member protrusion means for closing said fastener; and means connecting said handle member and said fastener body member permit rotational movement of said handle member and its movement toward and away from said strike member.

* * * * *